US006904638B2

(12) United States Patent
Flynn et al.

(10) Patent No.: US 6,904,638 B2
(45) Date of Patent: Jun. 14, 2005

(54) DRYING APPARATUS

(75) Inventors: Barry Flynn, Dublin (IE); Joseph Naughton, Corrandulla (IE); Hugh Mc Loughlin, Dublin (IE); Owen Laverty, Bray (IE)

(73) Assignee: Barema Limited, County Dublin (IE)

( * ) Notice: Subject to any disclaimer, the term of this patent is extended or adjusted under 35 U.S.C. 154(b) by 175 days.

(21) Appl. No.: 10/201,484

(22) Filed: Jul. 8, 2002

(65) Prior Publication Data

US 2003/0041404 A1 Mar. 6, 2003

(30) Foreign Application Priority Data

Jul. 6, 2001 (IE) ..... S2001/0638

(51) Int. Cl.[7] ..... A47L 11/29

(52) U.S. Cl. ..... 15/231; 15/228; 15/99; 34/95.3

(58) Field of Search ..... 15/231, 228, 99, 15/98; 34/95.3, 95, 95.1

(56) References Cited

U.S. PATENT DOCUMENTS 1,130,064 A * 3/1915 Buchanan ..... 15/228
2,452,744 A * 11/1948 Gardner ..... 242/539
2,690,582 A * 10/1954 Sundell ..... 15/228
4,121,315 A 10/1978 Buser
5,092,699 A * 3/1992 Silvenis ..... 401/21
5,327,609 A 7/1994 Bierma et al.
5,701,630 A * 12/1997 Liao ..... 15/228

FOREIGN PATENT DOCUMENTS

WO WO 97/03598 A1 2/1997
WO WO 01/82766 A2 11/2001

* cited by examiner

*Primary Examiner*—Robert J. Warden, Sr.
*Assistant Examiner*—Shay L Balsis
(74) *Attorney, Agent, or Firm*—Birch, Stewart, Kolasch & Birch, LLP

(57) ABSTRACT

A drying apparatus has a support frame mounted on a handle. A drying spool is rotatably mounted on the support frame and has a web of liquid absorbent material which is incrementally scrolled from the drying spool onto a take-up roller during use of the apparatus. A user grips the handle on the support frame to move the apparatus back and forth over a wet floor surface with the web in contact with the floor surface to dry the floor surface. Indexing means is provided for incrementally advancing the drying web from the drying spool to the take-up roller to advance the wet web onto the take-up roller. On the forward stroke the web is held immobile to dry the wet floor surface as it is pushed over the wet floor surface. On the reverse stroke the indexing means releases the take-up roller to wind the wet web portion onto the take-up roller and pull a dry portion of web from the drying spool at the start of the next forward drying stroke. After rotation of the take-up roller through a desired angle at the start of the forward stroke the indexing means locks the take-up roller for the remainder of the forward stroke.

16 Claims, 18 Drawing Sheets

DRYING APPARATUS

This invention relates to a drying apparatus, and in particular to a drying apparatus for floors, worktop surfaces and the like.

BACKGROUND OF THE INVENTION

In restaurants and public areas generally floor surfaces have to be cleaned on a regular basis. This typically involves mopping the floor and then leaving the floor to dry prior to use of the cleaned floor area. Usually, the newly cleaned floor area is cordoned off until it dries to prevent persons walking on the floor whilst wet and possibly slipping on the wet floor. It will be appreciated that this is very inconvenient, particularly in a restaurant for example, in that portions of the premises are unavailable for use for extended periods. Similarly, where spillages occur these have to be cleaned up and the floor left to dry over a period, again with the wet floor area cordoned off which interrupts the smooth flow of customers about the premises.

In the prior art WO 01/82766 disclosed a robotic floor mopping apparatus with motorised scrolling of a cleaning web between a feed roller and a take-up roller. In WO 97/03598 there is disclosed a dryer in which a drying web is scrolled between a supply roller and a take-up roller. Pawls engage rachette wheels at an end of each roller to prevent rotation of the rollers. Selective disengagement of the pawls is possible by manipulation of the handle of the apparatus and by tilting the apparatus so that an operative can advance the web between the supply roller and the take-up roller when desired. In U.S. Pat. No. 5,092,699 a floor cleaning device is disclosed having a removable cleaning cassette. In U.S. Pat. No. 5,327,609 a floor cleaner is disclosed having a cleaning cloth which is scrolled between two rollers by a drive motor continuously at low speed while operating the floor cleaner.

SUMMARY OF THE INVENTION

According to the invention there is provided a drying apparatus including:

a support frame, means for rotatably mounting a drying spool on the support frame, said drying spool having a web of liquid absorbent material wound about the spool, a take-up roller rotatably mounted on the support frame, the take-up roller being associated with the drying spool for reception of the web of liquid absorbent material form the drying spool, and means for scrolling the web of liquid absorbent material from the drying spool onto the take-up roller in a controlled manner.

In a particularly preferred embodiment indexing means is provided for incrementally feeding the web from the drying spool to the take-up roller in response to engagement and movement of the drying apparatus over a surface.

Advantageously the drying apparatus can be used to immediately dry a wet floor surface or indeed any other wet surface by moving the drying web over the surface to absorb moisture from the surface. The web is subsequently scrolled on when the portion in contact with the floor becomes wet. Thus conveniently floor areas subjected to cleaning can be readily easily and quickly dried so they are available for immediate use. The web is automatically scrolled on during operation of the apparatus.

In a preferred embodiment of the invention a complementary pair of scrolling rollers are rotatably mounted spaced-apart on the support frame, the scrolling rollers including the take-up roller and an associated supply roller adapted for reception of the drying spool.

In another embodiment the indexing means is operably connected to the take-up roller for incrementally turning the take-up roller through a desired angular rotation.

Preferably the indexing means provides for unidirectional rotation of the take-up roller.

In a further embodiment the indexing means includes a stepped endless track and an associated pawl which is moveable along the track to allow stepped rotation of the take-up roller in one direction and to brake the take-up roller against rotation in the opposite direction, one of the pawl and the track being on the roller and the other of the pawl and the track being on the support frame.

In another embodiment the take-up roller is arranged for engagement with the wet surface for drying said wet surface with the web wound about the take-up roller, the indexing means having means for locking the take-up roller on the support frame during a forward drying stroke of the apparatus in which the take-up roller is pushed across the wet surface and means for temporarily releasing the locking means to allow an incremental turn of the take-up roller to advance the web on the take-up roller before or at the start of each forward drying stroke of the apparatus.

In another embodiment the indexing means includes a stepped endless track and associated pawl which is moveable along the track to allow stepped rotation of the take-up roller in one direction and to brake the take-up roller against rotation in the opposite direction, one of the pawl and the track being on the take-up roller and the other of the pawl and the track being on the support frame. Conveniently the endless track may comprise a stepped circular groove in an end face of the take-up roller and the pawl is pivotally mounted on the support frame and has a follower pin which travels along said groove.

In another embodiment a web attachment means is provided on the take-up roller for releasable attachment of a leading edge of the web to the take-up roller.

In one embodiment the web attachment means comprises a web mounting slot extending substantially parallel to a rotational axis of the take-up roller along the outer surface of the take-up roller and a complementary clamp bar which is releasably engagable with the web mounting slot to clamp the web at the web mounting slot.

Conveniently the clamp bar may be adapted for snap engagement with the web mounting slot. In another embodiment the clamp bar is sideably engagable with the web mounting slot.

In a further embodiment complementary interengagable locking formations are provided on the web mounting slot and on the clamp bar.

In another embodiment the web attachment means includes a gripper flap which is pivotally mounted at an exterior of the take-up roller intermediate the ends of the take-up roller for pivotal movement about a pivot axis substantially parallel to the rotational axis of the take-up roller, said gripper flap having an outer free end which overlies an outer surface of the take-up roller for engaging and retaining the web between said outer free end and the outer surface of the take-up roller, biasing means for the gripper flap which urges the outer free end of the gripper flap towards the outer surface of the take-up roller.

In another embodiment brake means is provided to resists rotation of the drying spool on the drying spool mounting means. The brake means may include complementary interengagable formations on the drying spool and the mounting means for the drying spool, said formations co-operating to resist rotation of the drying spool on the drying spool mounting means. Said formations may comprise interengaging teeth on the drying spool and on the drying spool mounting means. In another embodiment the drying spool includes a tubular core about which the web is wound, an end cap mounted at an outer end of said core, a brake arm extending inwardly on said end cap and having a rib forming a tooth on the brake arm, an associated brake element on the support frame has a set of circumferentially spaced-apart teeth for co-operating interengagement with the rib on the brake arm, the rib on the brake arm of the end cap being engagable between adjacent teeth on the brake element, said brake arm being movable outwardly sufficiently to force the rib over the teeth on the brake element in response to the puling force applied to the web by the take-up roller when winding the web on the take-up roller.

In another embodiment the take-up roller has a grooved outer surface. Preferably a number of spaced-apart radial ribs project outwardly on the surface of the take-up roller. The ribs may extend between opposite ends of the roller.

In another embodiment the clamp bar is attached to a leading edge of the liquid absorbent web.

In a further embodiment means may be provided on the spool which co-operates with the spool mounting means to only allow mounting of the spool on the support frame in a desired orientation. In one embodiment where the spool has an axial bore which is slideably engagable with the supply roller said orienting means comprises a cap or cover extending across one end of the bore.

In another embodiment an inside face of the liquid absorbent web is coated with a water resistant material. This advantageously prevents wetting of a dry portion of the web by the used wet web portion previously scrolled onto the take-up roller when a new dry web portion is scrolled onto the take-up roller ready for use. This may be achieved in any suitable fashion. For example a liquid absorbent web may be formed as a laminate comprising a liquid absorbent web backed by a water impermeable web such as cellophane. Alternatively the inside face of the web may be sprayed or otherwise coated with a film of a water impermeable material.

In another embodiment a stand arm is provided on the support frame spaced away from the take-up roller for supporting the drying apparatus on the ground in a free standing position with the stand arm and take-up roller resting on the ground.

Conveniently the stand arm may be located at a front side of the take-up roller thus ensuring that the roller only engages the ground in a desired orientation associated with indexing of the take-up roller.

In another aspect of the invention there is provided a drying spool comprising a core about which a web of liquid absorbent material is wound, the core having means for mounting the spool on the drying apparatus.

In one embodiment a clamp bar for attachment to the take-up roller is mounted at a leading edge of the web of liquid absorbent material.

Conveniently means is provided at one end of the core which co-operates with the drying apparatus so that the drying spool can only be mounted in one desired orientation on the drying apparatus.

In a further aspect of the invention there is provided a drying web having a layer of liquid absorbent material a rear face of which is overlaid or coated with a layer or film of water impermeable material.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF PREFERRED EMBODIMENTS

Figure 1:
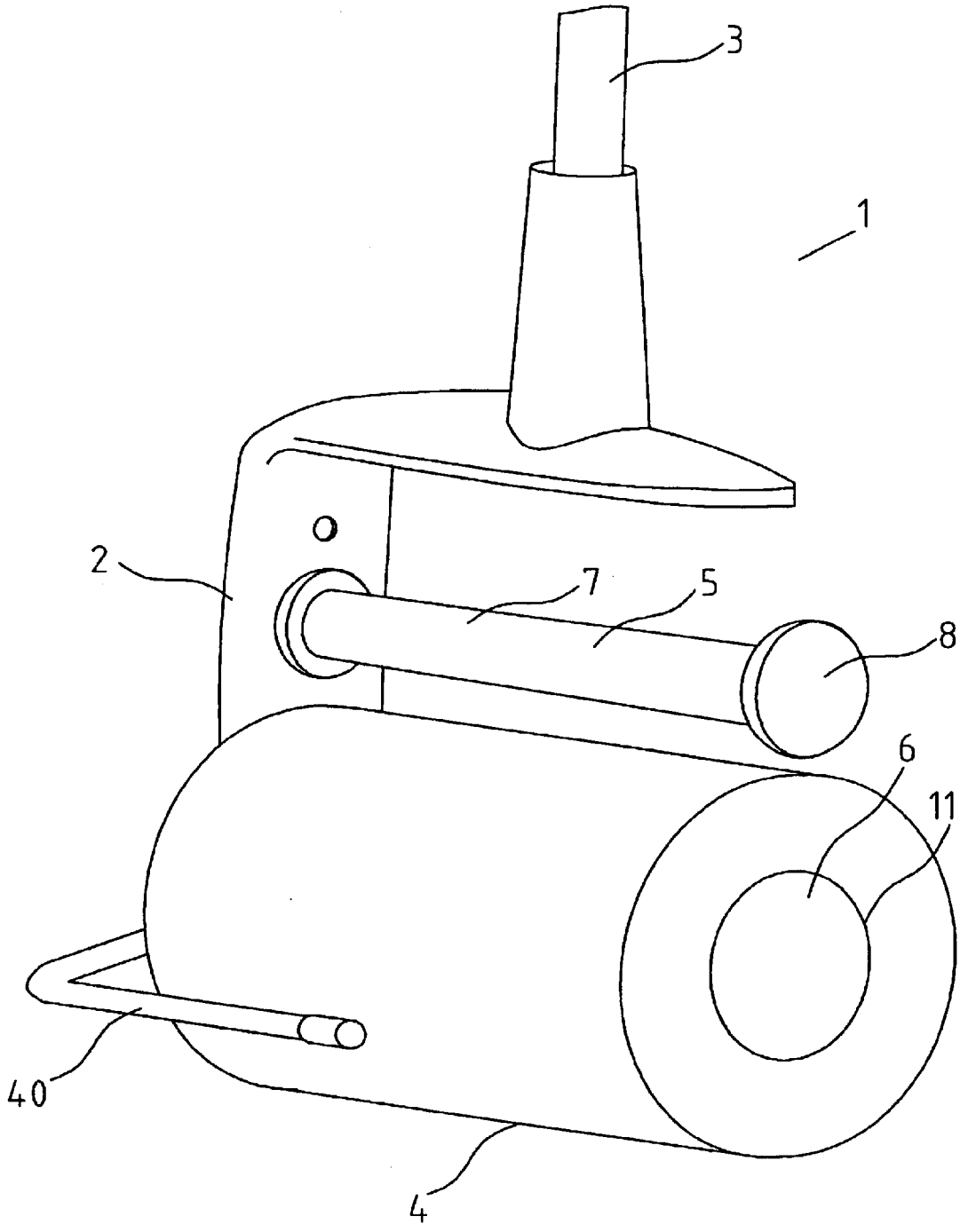
FIG. 1 is a perspective view of a drying apparatus according to the invention.

Referring to the drawings and initially FIGS. 1 to 15 thereof, there is illustrated a drying apparatus according to the invention indicated generally by the reference numeral 1. The drying apparatus 1 has a support frame 2 with a handle 3. A complementary pair of scrolling rollers are rotatably mounted vertically spaced-apart on the support frame 2 and include a supply roller 5 and an associated take-up roller 6. A drying spool (not shown) having a web of liquid absorbent material wound about the spool, can be mounted on the supply roller 5 and scrolled incrementally onto the take-up roller 6 whilst pushing the take-up roller over a wet surface to absorb moisture from the wet surface thus drying the wet surface. A drying web 4 is shown fully wound up on the take-up roller 6 in FIGS. 1 to 3.

The supply roller 5 comprises an outer sleeve 7 which is rotatably mounted upon a spindle (not shown) secured to the support frame 2 and extending outwardly there from in cantilevered fashion. A removable end cap 8 at a free end of the sleeve 7 retains a spool with a web of liquid absorbent material wound about the spool on the sleeve 7 in use. Some form of friction resistance or braking may be applied to the sleeve 7 to resist pulling off the web from the spool so that the web will not freely run off the spool but must be pulled from the spool by the take-up roller 6.

Figure 4:
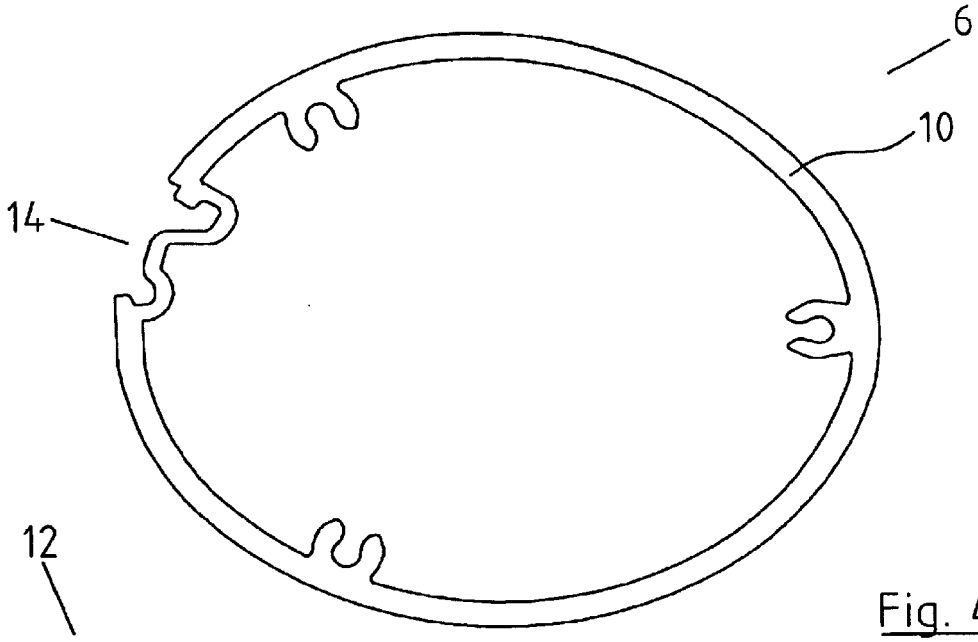
FIG. 4 is a detail sectional end elevational view of a take-up roller forming portion of the drying apparatus.
Figure 6:
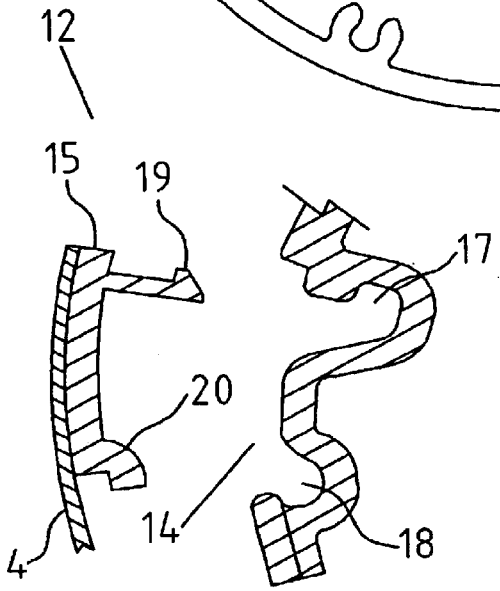
FIG. 6 is a detail exploded sectional end elevation view showing a web clamping portion of the take-up roller.
Figure 5:
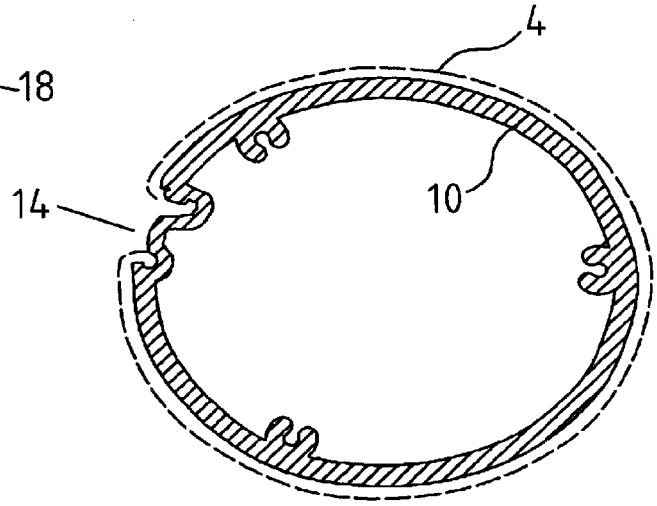
FIG. 5 is a view similar to FIG. 4 showing a liquid absorbing web wound about the roller.

The take-up roller 6 has a cylindrical drum 10 (FIG. 4). Circular bearing plates 11 engage in opposite ends of the drum 10, a spindle 13 (FIG. 7) on the support frame 2 rotatably engaging the bearing plates 11 to rotatably mount the drum 10 on the spindle for rotation of the take-up roller 6.

Web attachment means indicated generally by the reference numeral 12 is provided on the take-up roller 6 for attachment of a leading edge of a drying web 4 to the take-up roller 6. Said web attachment means comprises a web mounting slot 14 extending substantially parallel to a rotational axis of the take-up roller 6 along an outer surface of the drum 10 and a complementary clamp bar 15 which is releasably engagable with the web mounting slot 14 to clamp the web at the slot 14. While the drying web could simply be inserted into the slot 14 and then clamped in place by the clamp bar 15 it is envisaged that the clamp bar 15 will be attached to a free end of the web. This will ensure that engagement of the web with the take-up roller 6 can be easily and quickly achieved. It will also ensure that the web is correctly aligned with the take-up roller 6 so that it is scrolled onto the take-up roller 6 evenly.

It will be noted that complementary interengagable locking formations are provided on the web mounting slot 14 and on the clamp bar 15. In this case the locking formations comprise female sockets 17, 18 of the slot 14 which receive complementary male projections 19, 20 on the clamp bar 15. Thus the clamp bar 15 can be snapped into engagement with the slot 14 for quick loading.

It will be noted also that the clamp bar 15 can be slid longitudinally in an axial direction to remove the clamp bar 15 and the associated used web which is wound up on the take-up roller 6 to remove the used roll of web from the take-up roller 6. In this regard, although not illustrated in the drawings it is desirable that the drum 10 of the take-up roller 6 has a grooved outer surface which may be formed by a number of spaced-apart radial ribs projecting outwardly from the surface of the drum 10. This advantageously reduces the surface area of the drum 10 in contact with the web of drying material sufficiently to allow the used web wound on the take-up roller 6 to be readily easily removed.

From a manufacturing point of view it will be noted that the drum 10 can be conveniently formed as an aluminium extrusion for example. Thus it is relatively easy and cheap to manufacture.

Indexing means is provided for incrementally feeding the drying web from the drying spool mounted on the supply roller 5 to the take-up roller 6. In this case the indexing means comprises a stepped endless track 30 (FIG. 7) on an end cover 11 supporting the drum 10 rotatably on the spindle 13 attached to the support frame 2. A pawl 31 associated with the track 30 is slideably moveable along the track 30 to allow stepped rotation of the take-up roller in one direction only. The pawl 31 is mounted on a carrier arm 32 which is pivotally mounted by a pivot pin 33 on a support frame 2 or inner end of spindle 13 adjacent the end cover 11.

Figure 7:
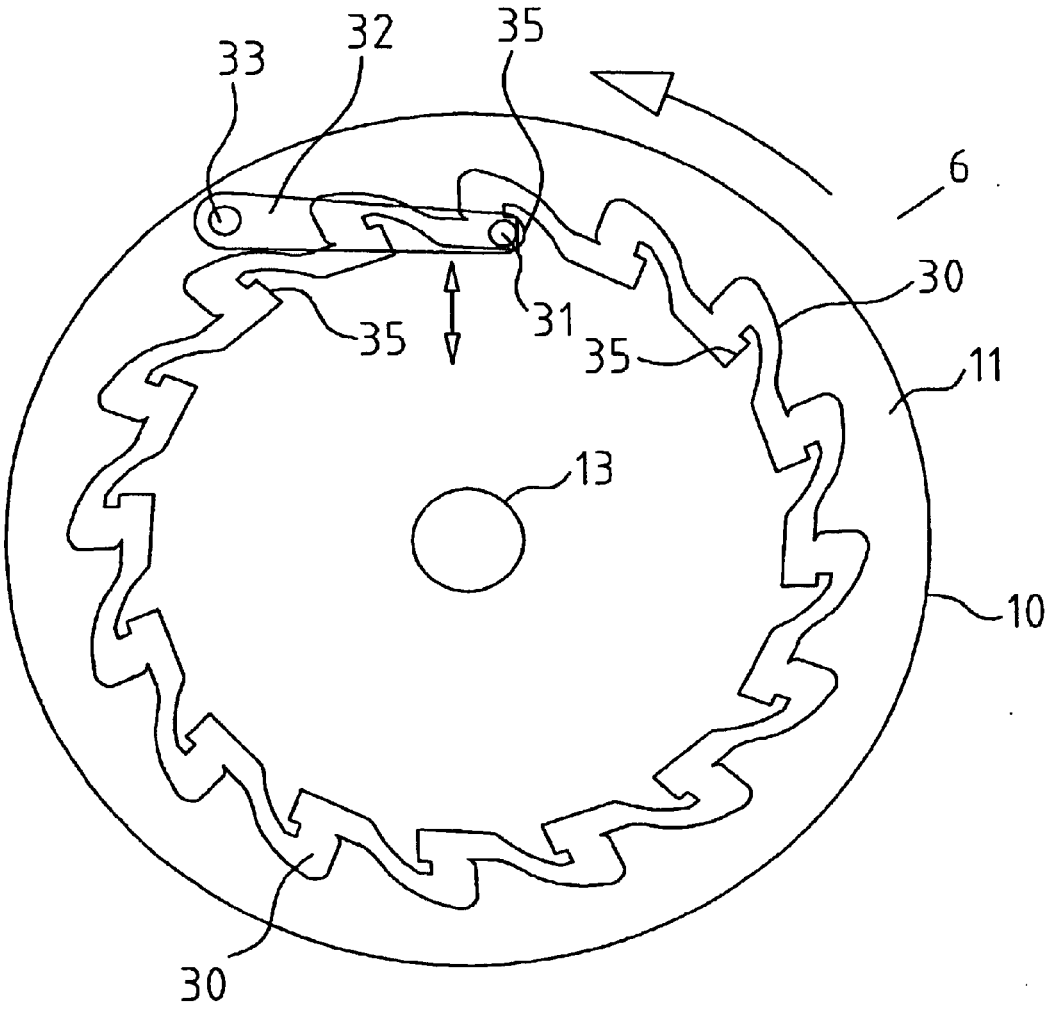
FIG. 7 is a detail end elevational view of the take-up roller showing an indexing system used with the take-up roller.
Figure 8:
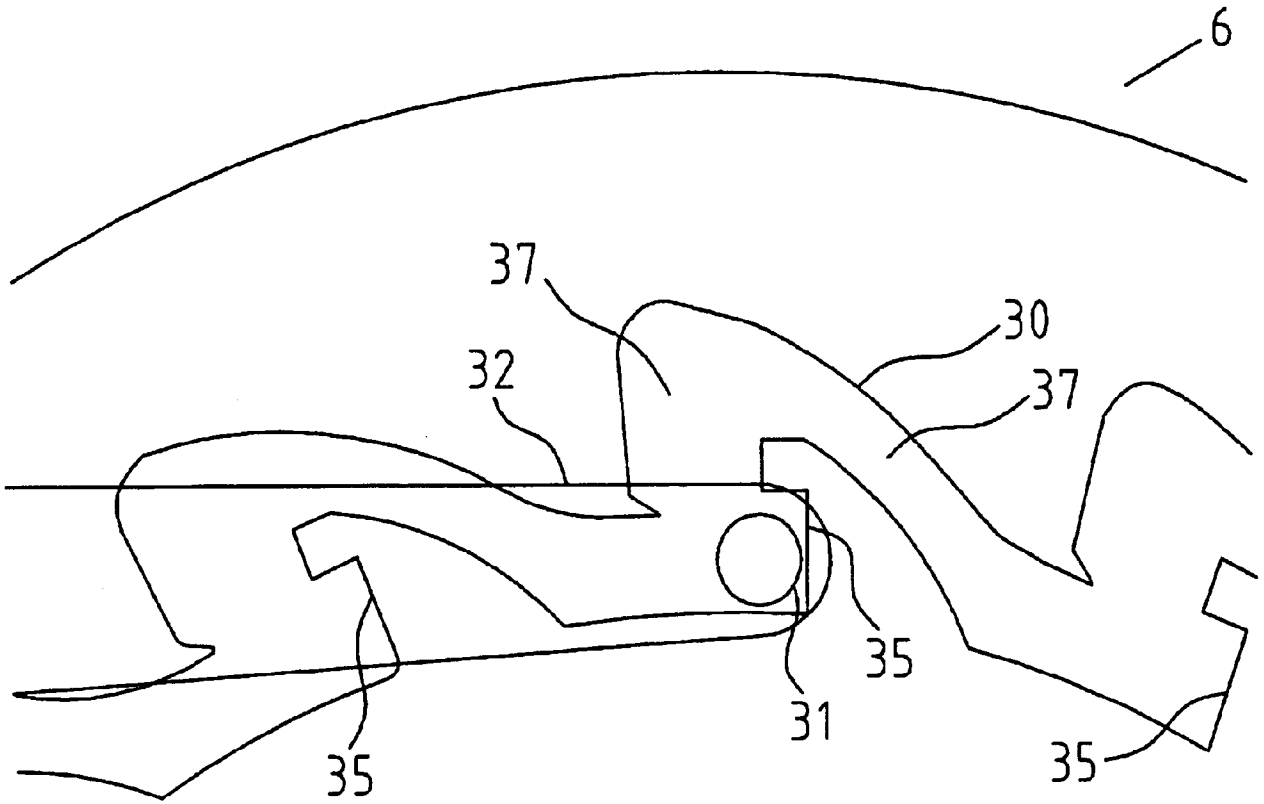
FIG. 8 is a detail elevational view showing portion of the indexing system in a first position of use.

FIGS. 7 and 8 show a first position of the pawl 31 in which the pawl 31 engages against an inner land 35 of the track 30 to prevent rotation of the take-up roller 6 as the take-up roller 6 is pushed forwardly across a wet surface. Thus the portion of the web in contact with the wet surface absorbs moisture from the wet surface drying the wet surface.

Figure 9:
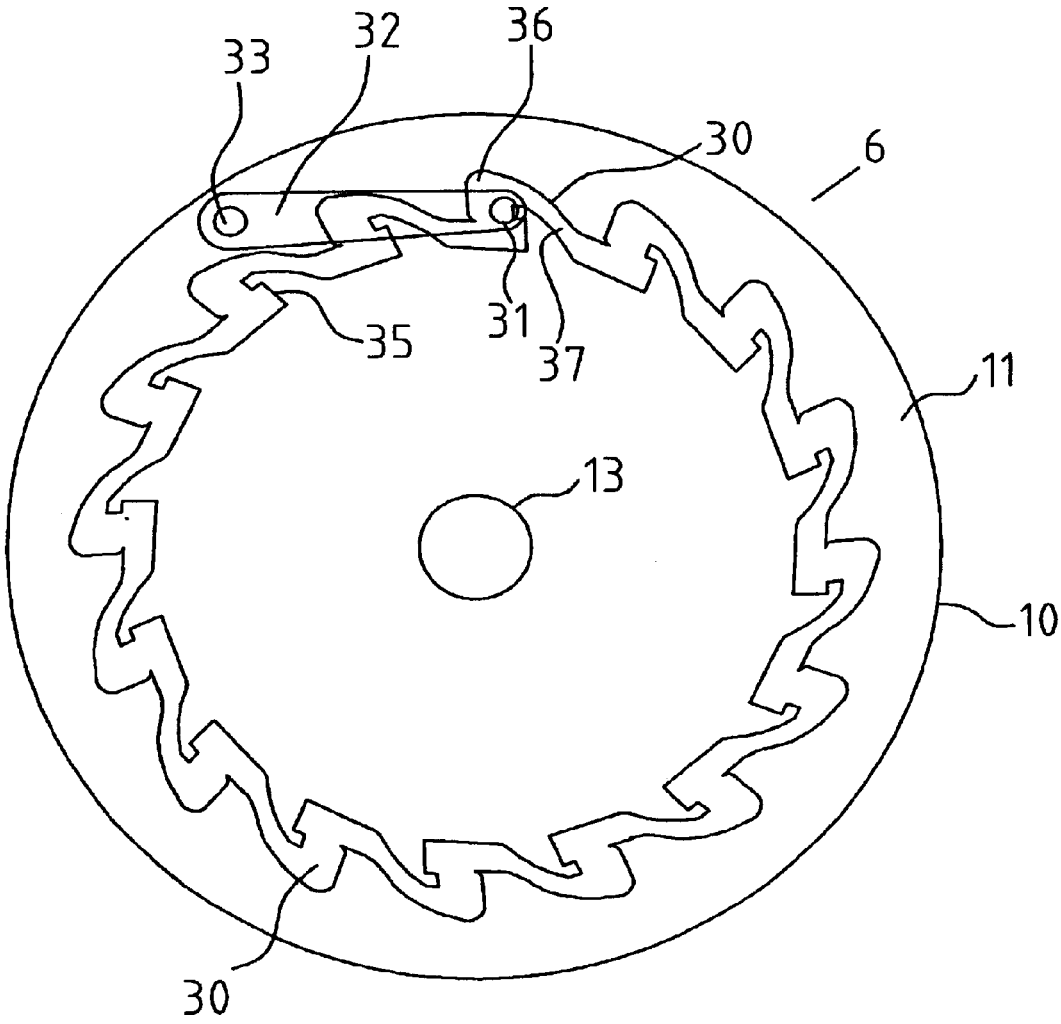
FIG. 9 is a view similar to FIG. 7 showing the indexing system in a second position of use.
Figure 10:
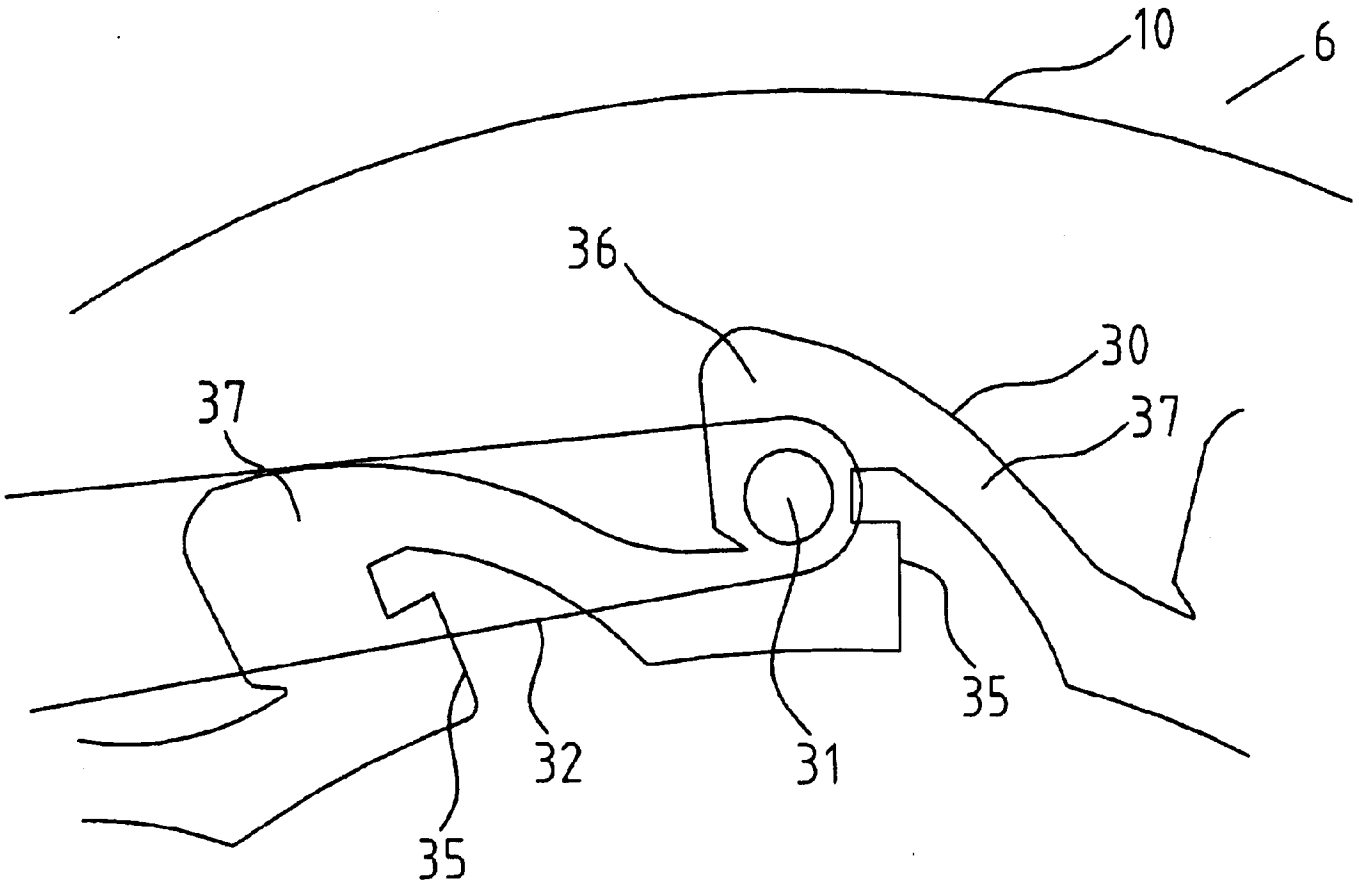
FIG. 10 is a view similar to FIG. 8 showing the indexing system in the second position of use.

FIGS. 9 and 10 show a second position of use for the indexing mechanism. When the take-up roller 6 has been pushed fully forward and its direction is reversed, pulling back the take-up roller 6 the pawl 31 rides upwardly and outwardly through a radial portion 36 of the track 30. A spring (not shown) which engages the carrier arm 32 urges the carrier arm 32 and hence the pawl 31 outwardly through the radial portion 36.

Figure 11:
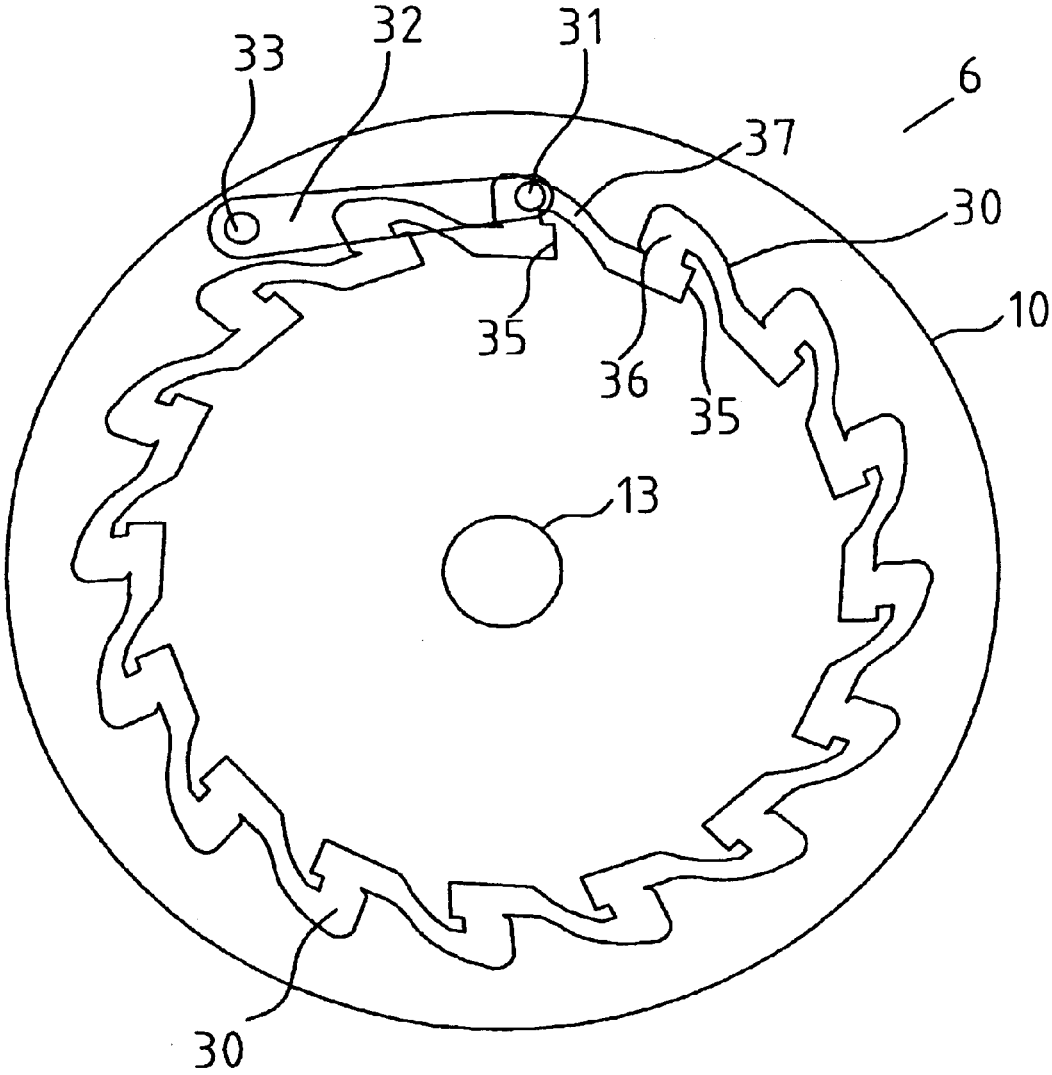
FIG. 11 is a view similar to FIG. 7 showing the indexing system in a third position of use.
Figure 12:
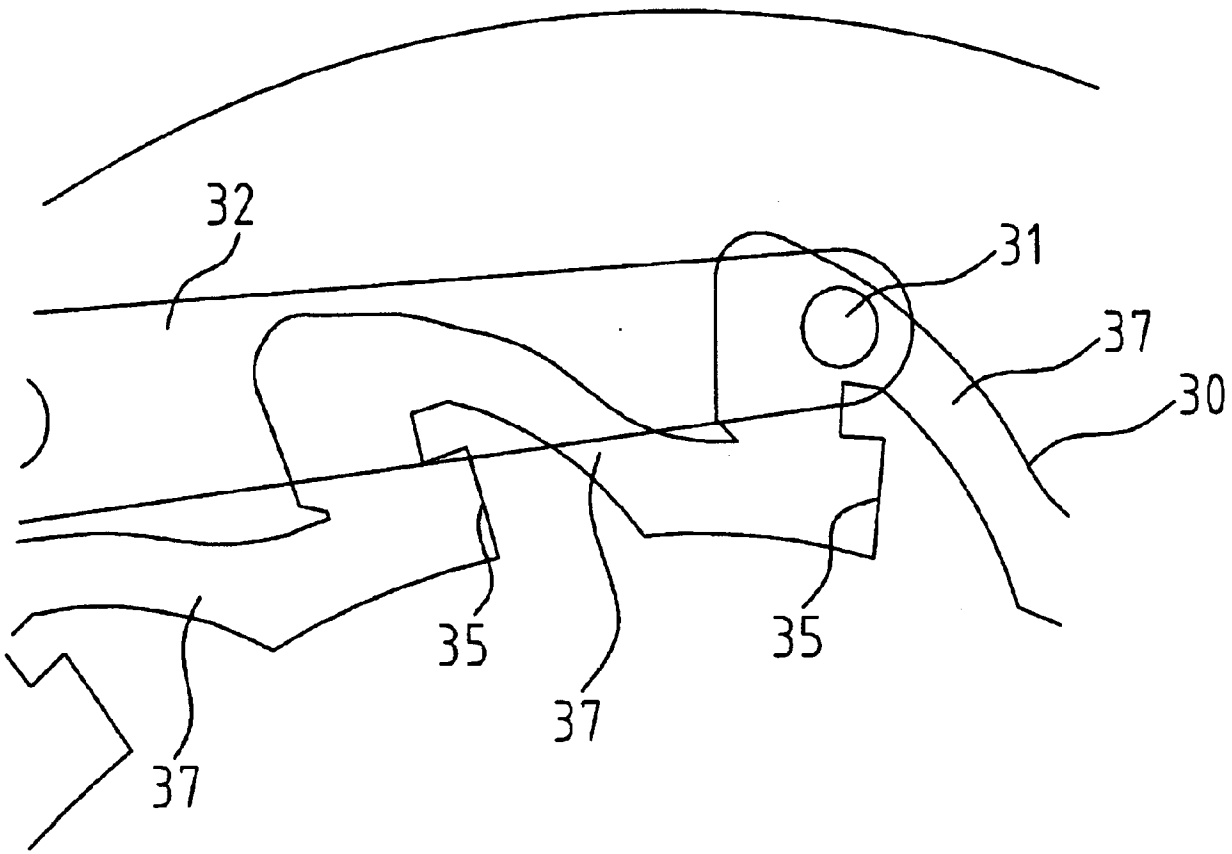
FIG. 12 is a view similar to FIG. 8 showing the indexing system in the third position of use.
Figure 13:
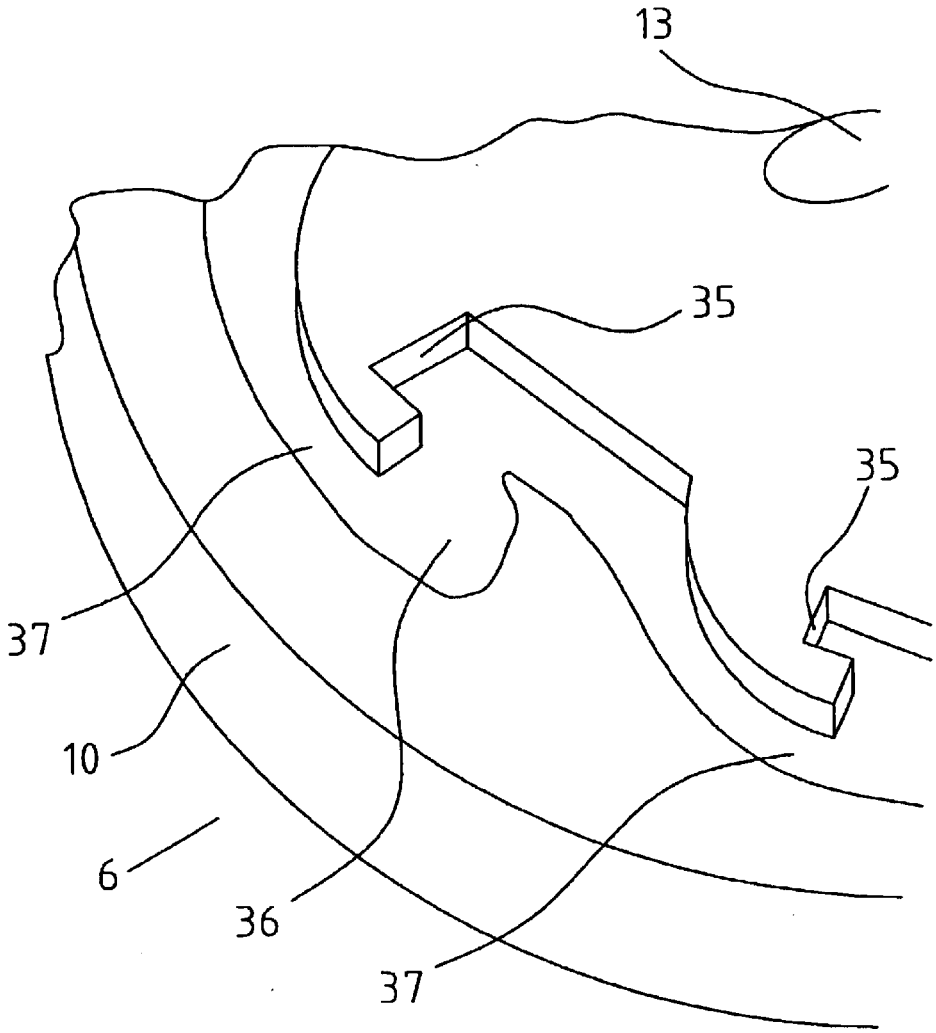
FIG. 13 is a detail perspective view illustrating part of a track portion of the indexing system.
Figure 14:
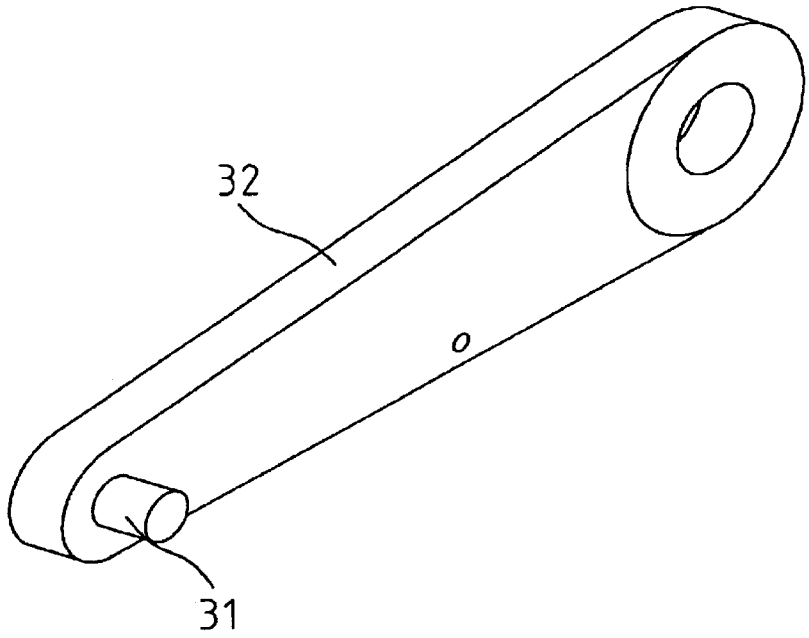
FIG. 14 is a detail perspective view showing a pawl of the indexing system.

FIGS. 11 and 12 show a third operating position of the indexing system. In this case as the take-up roller 6 is pushed forward the pawl 31 slides inwardly through a curved portion 37 of the track 30 to engage against the next land 35 at which it locks the take-up roller 6 which continues forward on the push stroke pushing the web in contact with the ground over the wet surface to absorb moisture from the wet surface. Thus at the start of each forward stroke the take-up roller 6 is indexed forward to bring a dry portion of the web into contact with the wet surface and then this is slid across the wet surface absorbing moisture from the wet surface to dry the wet surface.

A stand arm 40 is mounted on the support frame 2 and projects forwardly therefrom and laterally across in front of the take-up roller 6. This stand arm 40 allows the drying apparatus 1 to be stood in a generally upright free-standing position with the stand arm 40 and take-up roller 6 resting on the ground. The stand arm 40 further ensures the drying apparatus 1 is pushed forward and back during use in the right orientation for properly indexing the drying web onto the take-up roller 6.

Figure 15:
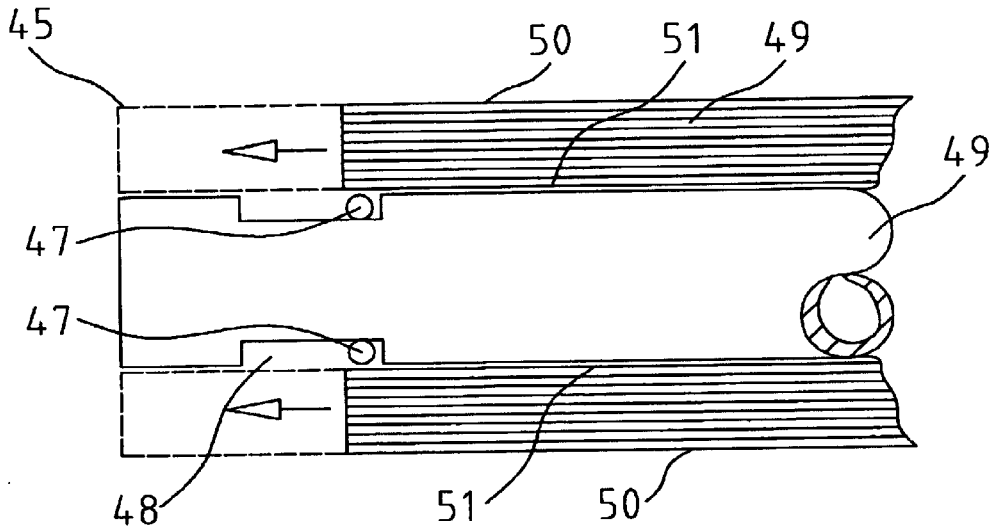
FIG. 15 is a detail elevational view of a drying web supply roller of the apparatus.
Figure 16:
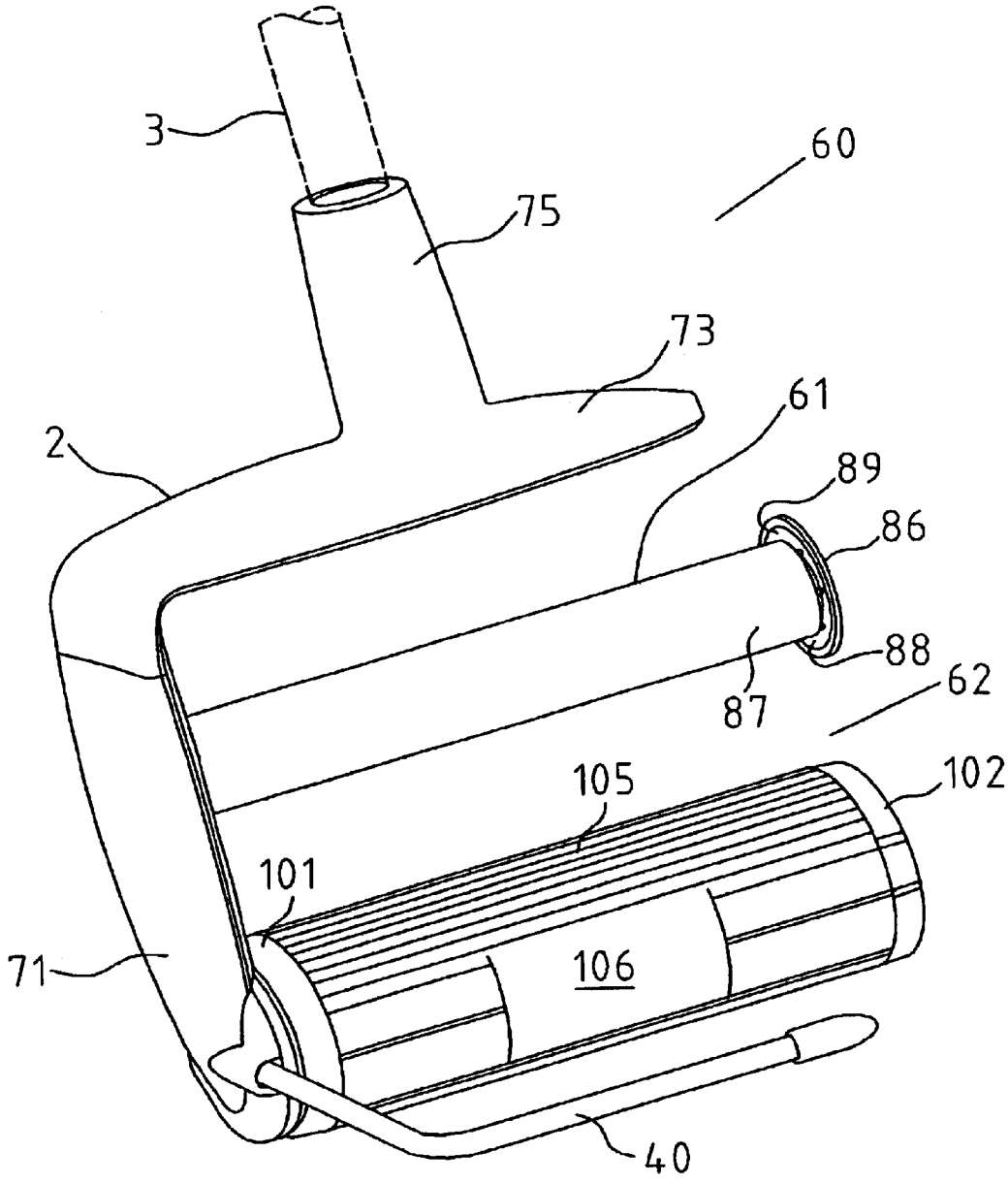
FIG. 16 is a perspective view of a drying apparatus according to a second embodiment of the invention.
Figure 17:
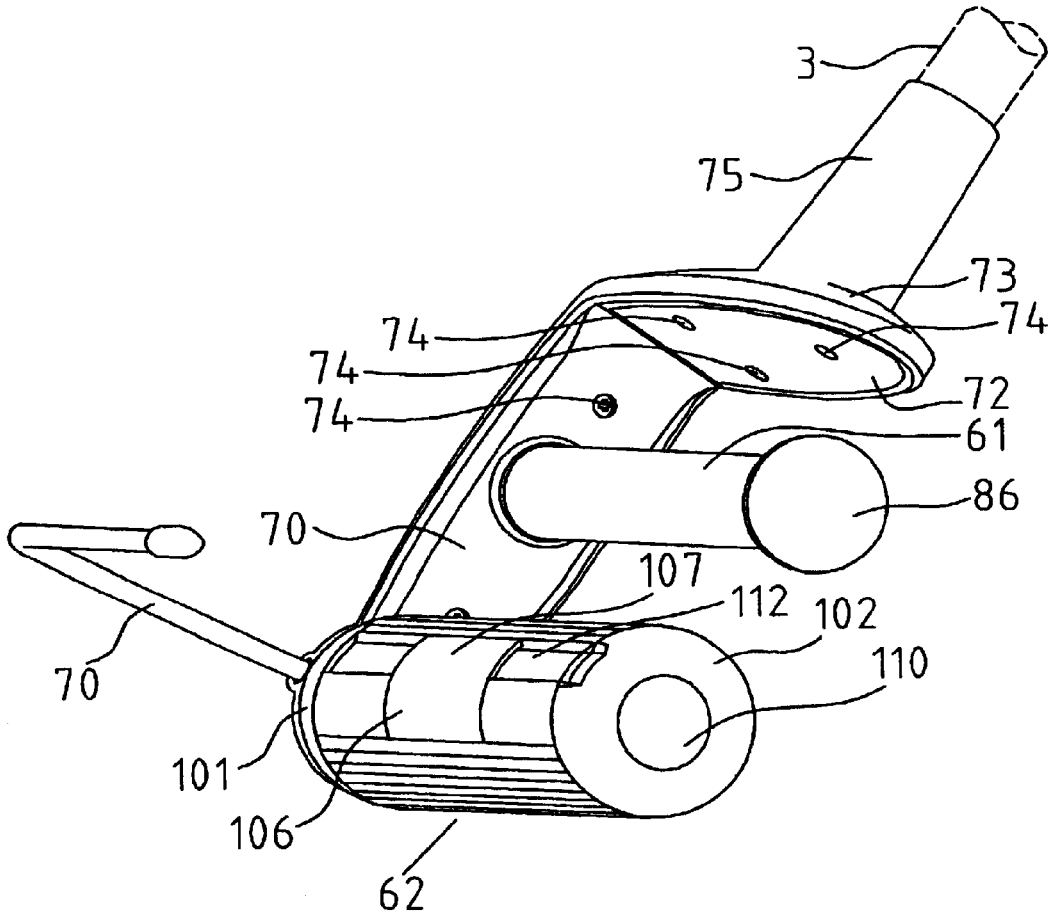
FIG. 17 is an underneath perspective view of the drying apparatus of FIG. 16.

Referring now in particular to FIG. 15 one possible construction of supply roller 45 is shown. In this case the supply roller 45 comprises a cylindrical body 46 which is attached to the support frame 2. An O-ring 47 is mounted within an associated circumferential groove 48 located adjacent an inner end of the body 46. A drying spool 49 comprises a web 50 of liquid absorbent material wound about a tubular core 51. To mount the drying spool 49 on the body 46 of the supply roller 45 the core 51 is pushed onto the body 46 in the direction of the arrows in the drawing compressing the O-ring 47 within the groove 48 to frictionally engage the supply spool 49 and preventing free rotation of the spool 49 on the body 46. Thus the spool 49 will only turn on the body 46 when the take-up roller is indexed forward pulling the web 50 from the spool 49. The O-ring 47 rolls between opposite ends of the groove 48 to facilitate loading and unloading of the drying spool 49.

In use, a drying spool having a web of liquid absorbent material wound about the spool is slid onto the collar 7 of the supply roller 5 and retained on the supply roller 5 by the end cap 8. A leading edge of the web with the clamp bar 15 attached is secured to the take-up roller 6, the clamp-bar 15 snapping into engagement with the slot 14 in the take-up roller 6. A user then grips the handle 3 and works the take-up roller 6 back and forth across a wet surface to dry the wet surface. As the drying apparatus 1 is pushed back and forth over the wet surface the web incrementally scrolls from the supply roller 5 onto the take-up roller 6. At the start of each forward stroke the take-up roller 6 indexes on bringing a dry piece of web into contact with the floor and then continued pushing slides the dry web over the wet floor to soak up moisture from the floor as the apparatus 1 is pushed forward and back. When the drying web has been fully scrolled onto the take-up roller 6 the wet roll can be slid off the take-up roller axially and discarded and then a fresh drying spool mounted on the supply roller 5 and connected to the take-up roller 6.

Figure 2:
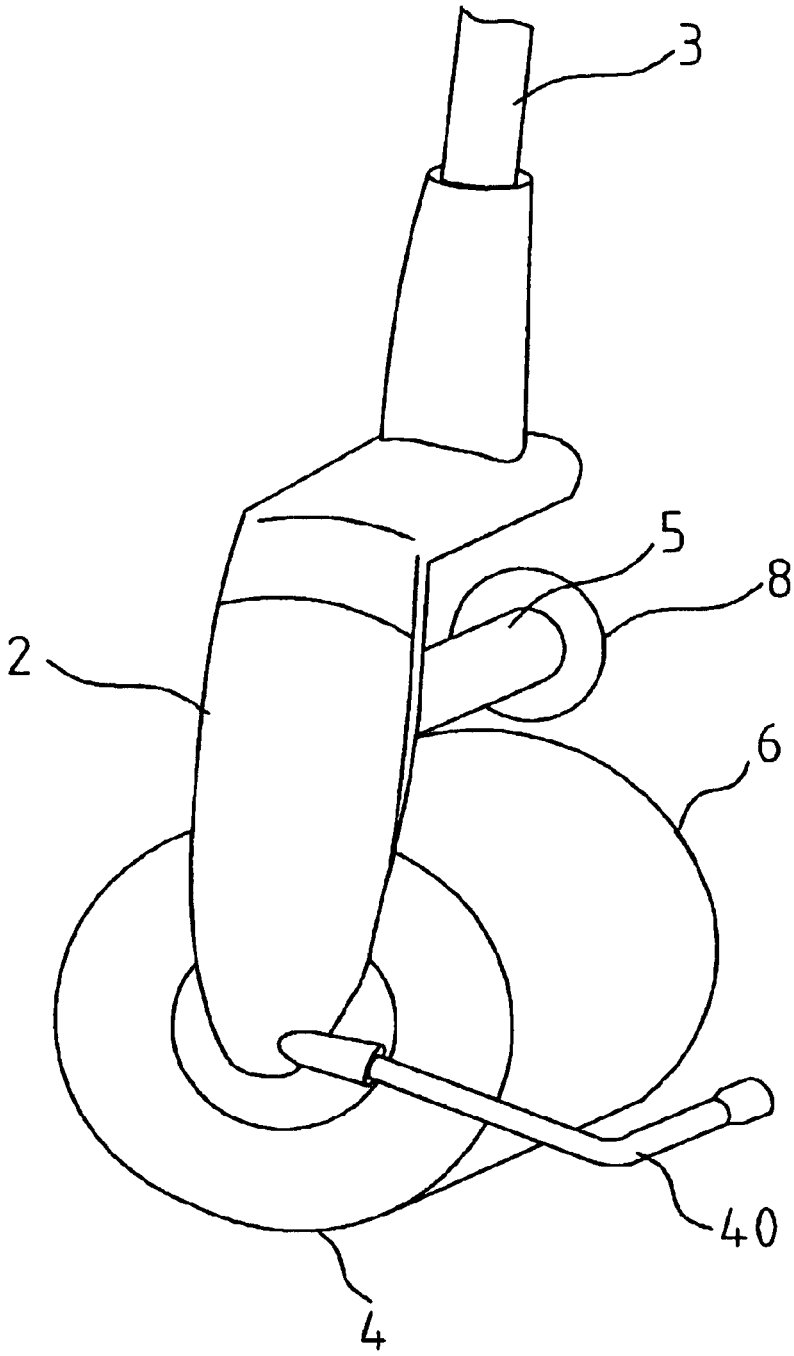
FIG. 2 is another perspective view of the drying apparatus.
Figure 3:
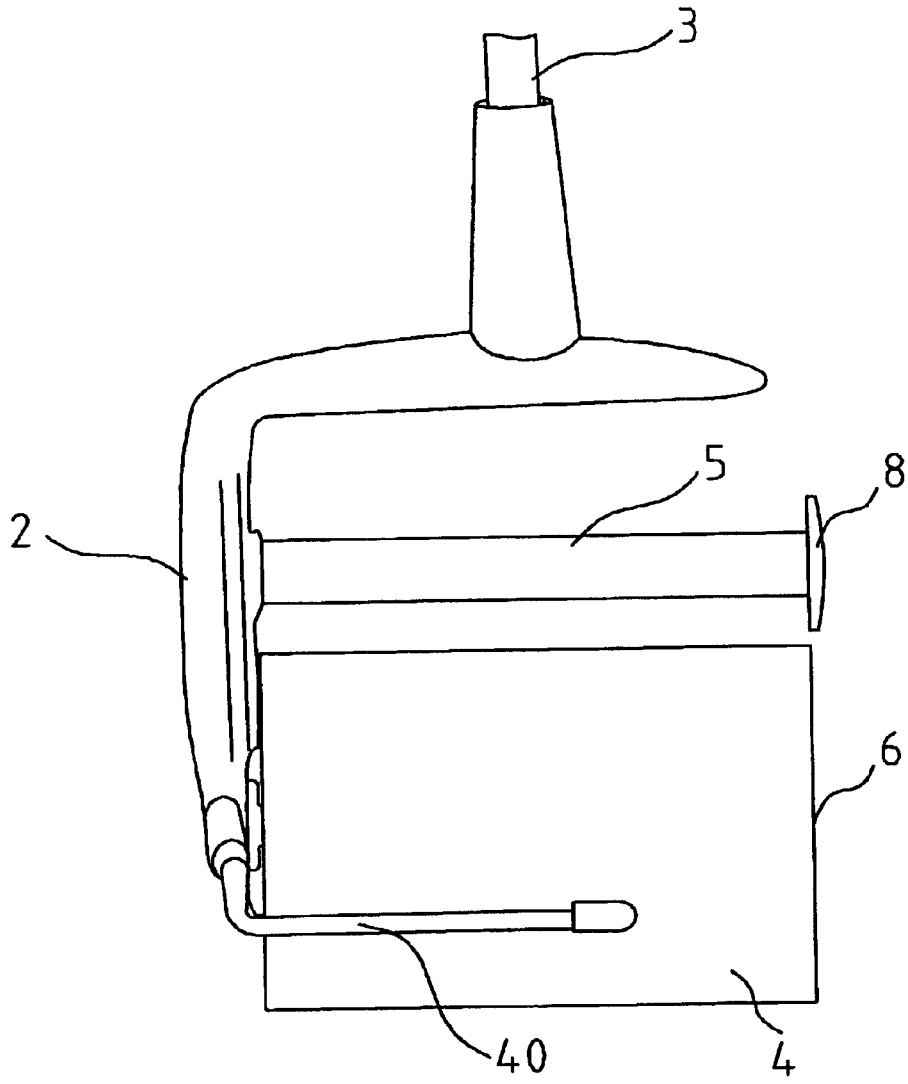
FIG. 3 is a front elevational view of the drying apparatus.

In FIGS. 1 to 3 a drying web 4 is shown fully wound up on the take-up roller 6 after use. The drying web may be of any suitable material. An unwoven paper web has been found to be particularly good at absorbing moisture, however various other absorbent materials may alternatively be used for the web. It is envisaged that the drying web may conveniently be formed with a layer of liquid absorbent material a rear face of which is overlaid or coated with a layer or film of water impermeable material. This will prevent or minimise dampening of a dry portion of the web when it is indexed onto the take-up roller by the already wet used web on the take-up roller.

Referring now to FIGS. 16 to 20 there is shown another drying apparatus according to a second embodiment of the invention indicated generally by the reference numeral 60. Parts similar to those described previously are assigned the same reference numerals. A drying spool 61 is mounted on the support frame 2 above, vertically spaced-apart from and substantially parallel to an associated take-up roller 62. In use the take-up roller 62 is moved back and forth over a wet floor surface to dry the floor surface by means of a drying web which is scrolled from the drying spool 61 and wound up on the take-up roller 62.

The support frame 2 comprises an inner metal skeleton 64 of L-shaped construction having an upright side bar 65 bent over at its upper end to form a top crossbar 66. A pair of spaced-apart substantially parallel support spindles, namely a top spindle 67 and a bottom spindle 68 project laterally outwardly from an inner side face of the side bar 65 below and substantially parallel to the top crossbar 66. The stand arm 40 projects forwardly at a bottom end of the side bar 65.

The metal skeleton 64 is encased within a plastics housing having four parts arranged in two pairs of parts which clamp about the side bar 65 and the top crossbar 66. These parts include an inner side casing 70 and associated outer side casing 71 which fit about and enclose the side bar 65. An inner top casing 72 and an outer top casing 73 encase the top crossbar 66. The side casing parts 70, 71 and the top casing parts 72, 73 are screwed together by screw fasteners 74 which pass through associated holes in the side bar 65 and top crossbar 66 respectively. A handle mount 75 with a socket 76 is provided in the top casing 73 for reception of a lower end of the handle 3.

The supply spool 61 is of tubular construction and typically will be of cardboard material. The drying web 4 is wound about the supply spool 61 (shown in broken outline in FIG. 18). An inner end 80 of the supply spool 61 rotatably engages a bearing mount 82 which projects inwardly from and is integrally formed with the inner side casing 70 and seats over the top spindle 67 which projects through the bearing mount 82. A conical tapered lead-in 83 to a cylindrical bearing surface 84 is provided on the bearing mount 82. In use the inner end 80 of the supply spool rotates on the bearing surface 84.

An end cap 86 is a push fit into an outer end 87 of the supply spool 61. The end cap 86 has a dished flange 88 which projects radially outwardly of the supply spool 61. Projecting inwardly from an inner concave face 89 of the flange 88 is a tubular mounting spigot 90 (FIG. 19) having circumferentially spaced-apart ribs 91 which engage in an interference fit within a bore 88 of the supply spool 61 at the outer end 87 to rigidly mount the end cap 86 at the outer end 87 of the supply spool 61. In this way, it will be appreciated that the supply spool 61 can only be mounted in one (correct) orientation on the top spindle 67. A set of four juxtaposed retaining arms 92 located within the spigot 90 extend inwardly from the inner face 69 of the flange 88 to engage and grip an outer end of the top spindle 67 which has a circumferential groove adjacent the outer end of the spindle 67 which is gripped by the end cap 86 to retain the end cap 86 with supply spool 61 on the top spindle 67. Inboard of the groove and adjacent the outer end of the top spindle 67 a brake element 94 is provided. This brake element 94 has a tubular body 97 set of circumferentially spaced-apart teeth 95 on an outer surface thereof. An associated brake arm 96 extends inwardly from the inner face 89 of the end cap 86 and hat a rib for engagement with the teeth 95 on the brake element 94. This prevents free rotation of the supply spool 61. The brake arm 96 will deflect outwardly sufficiently to force the rib over the teeth 95 on the brake element 94 allowing the supply spool 61 to rotate in response to the pulling force applied to the web 4 by the take-up roller 62 when winding the web 4 on the take-up roller 62. An inner bore 98 of the brake element 94 engages and holds the brake element 94 on the top spindle 67. An annular bearing flange 99 at an inner end of the brake element 94 has an outer rim which rotatably supports the outer end 87 of the drying spool **6*e*1** within which it is housed.

Figure 18:
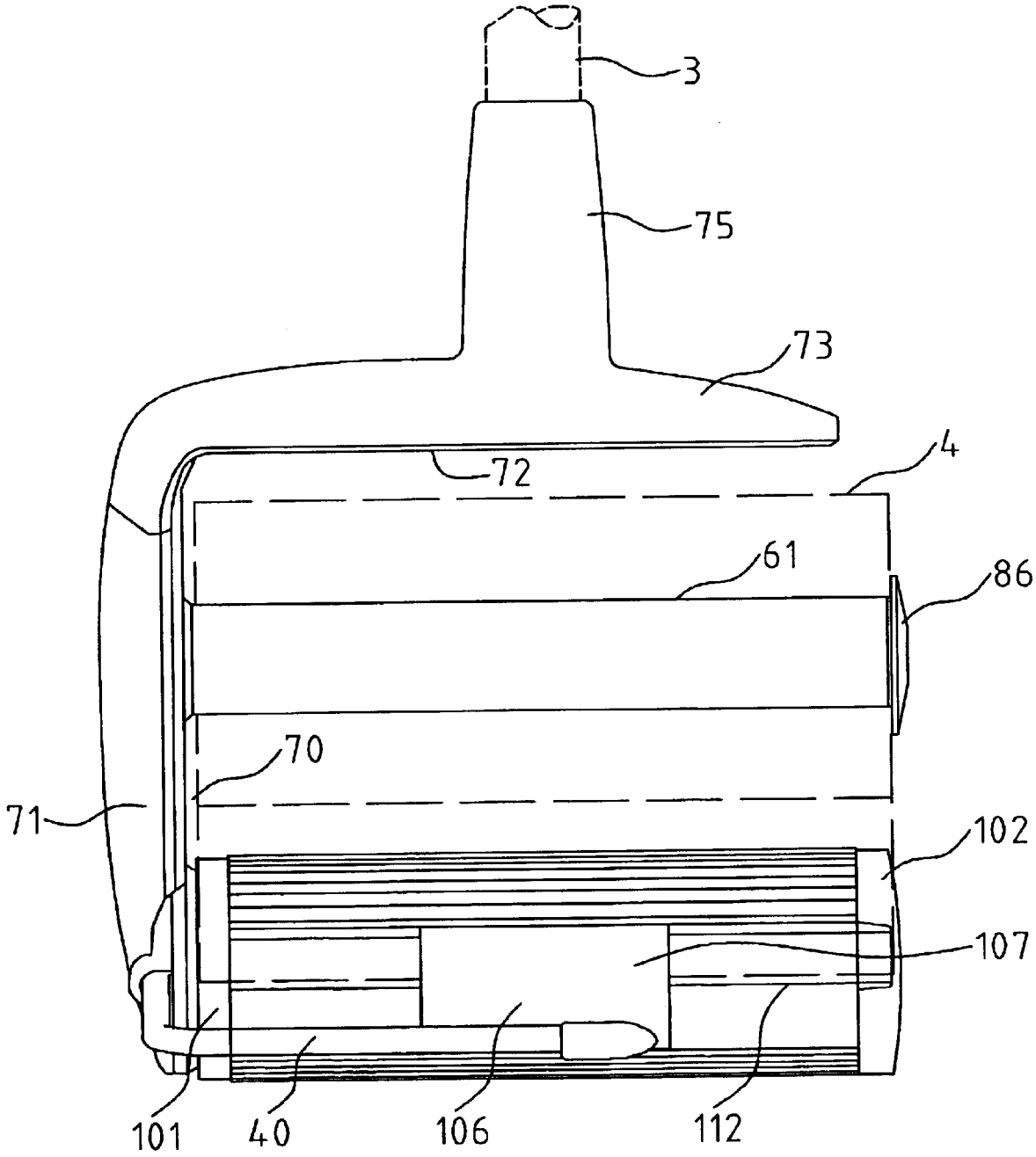
FIG. 18 is a front elevational view of the drying apparatus of FIG. 16.
Figure 19:
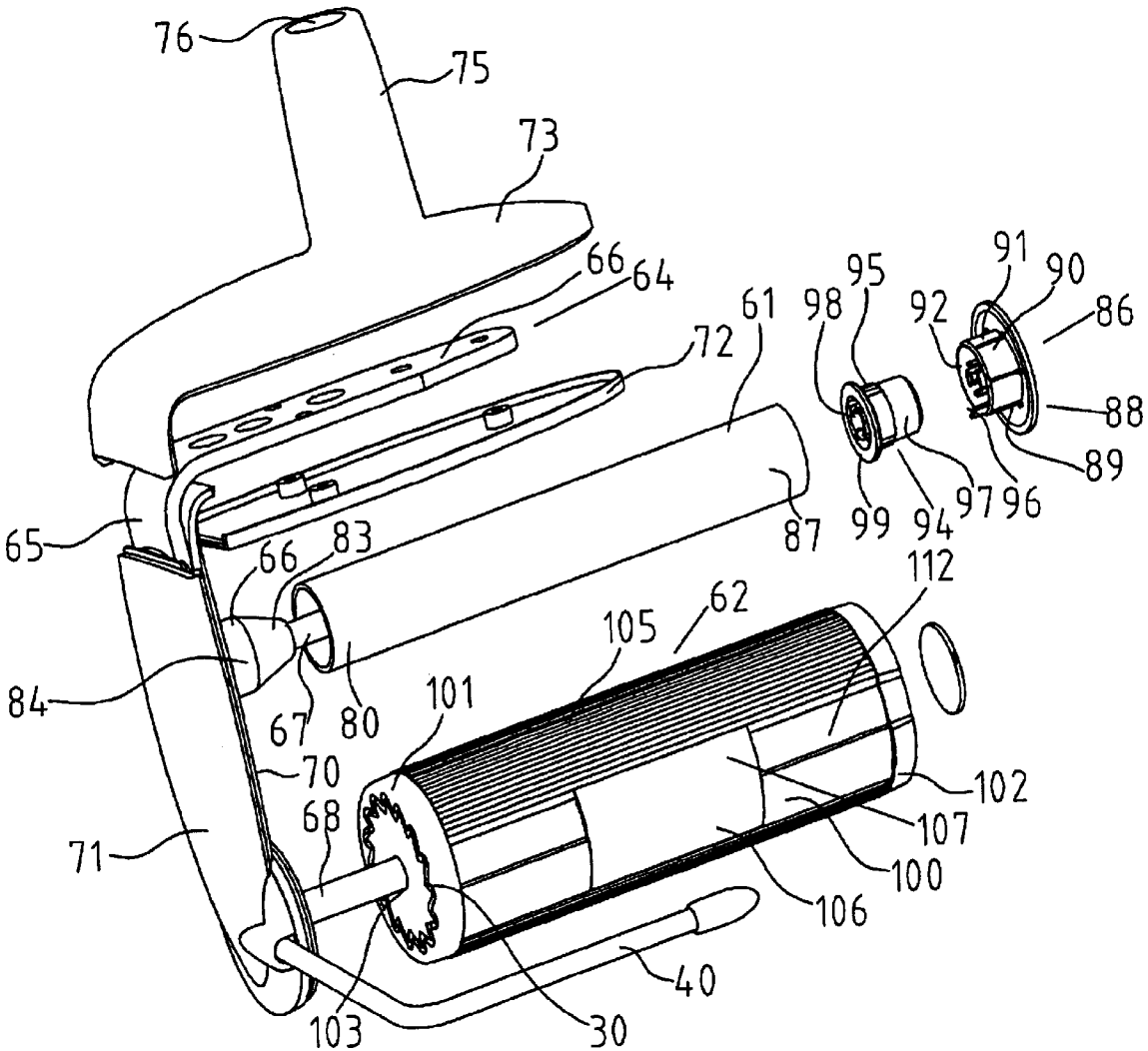
FIG. 19 is a partially exploded perspective view of the drying apparatus of FIG. 16.
Figure 20:
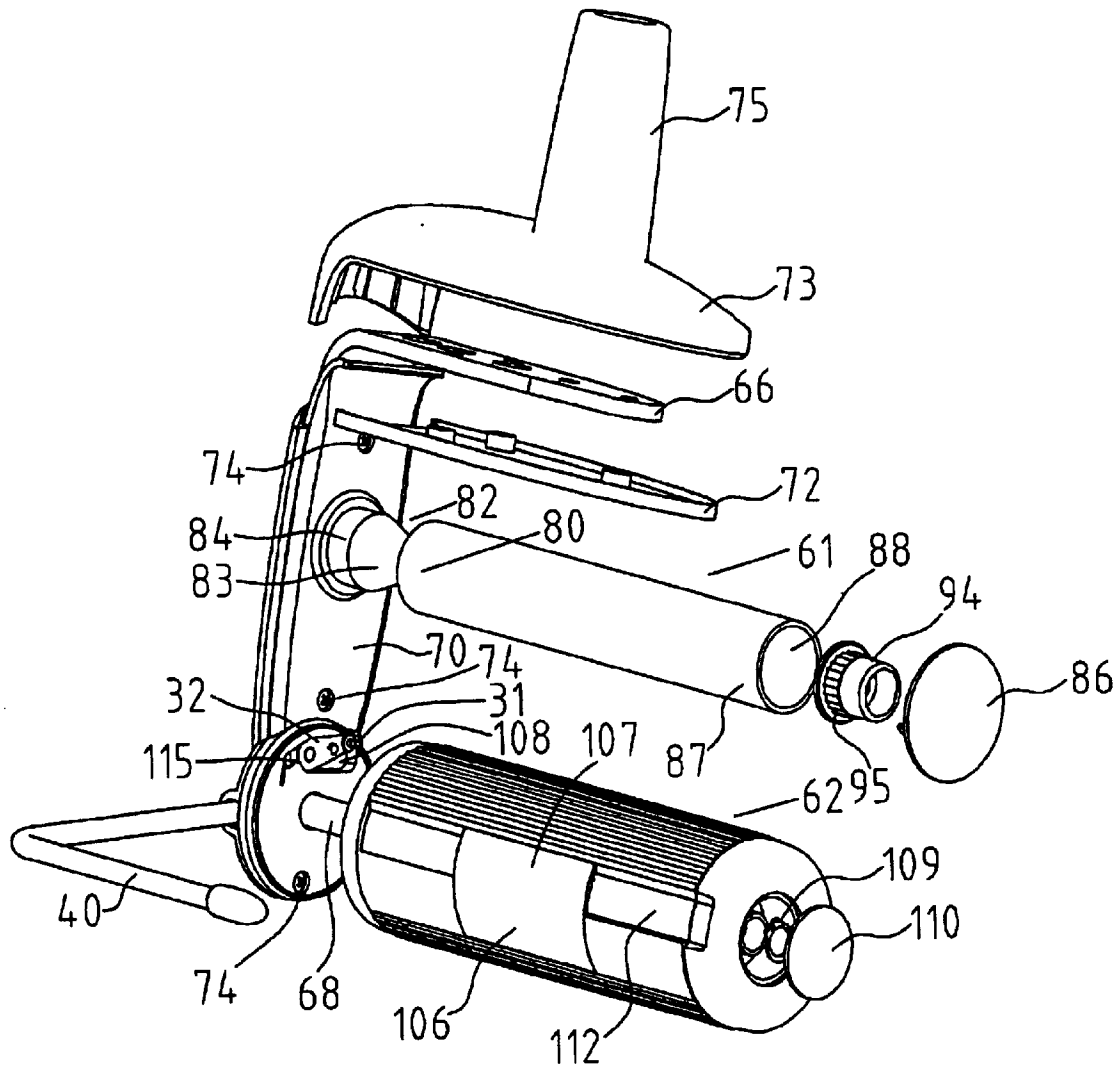
FIG. 20 is another partially exploded perspective view of the drying apparatus of FIG. 16.
Figure 21:
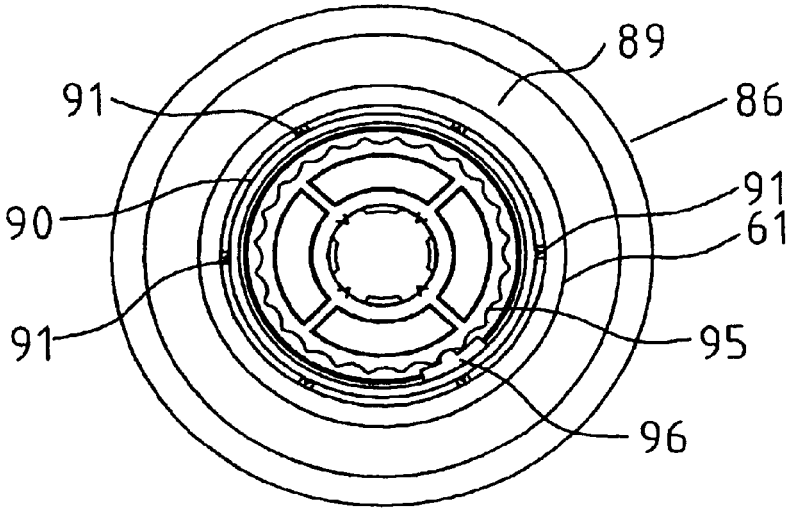
FIGS. 21 and 22 are detail end views of the drying spool and take-up roller respectively of the drying apparatus of FIG. 16.
Figure 22:
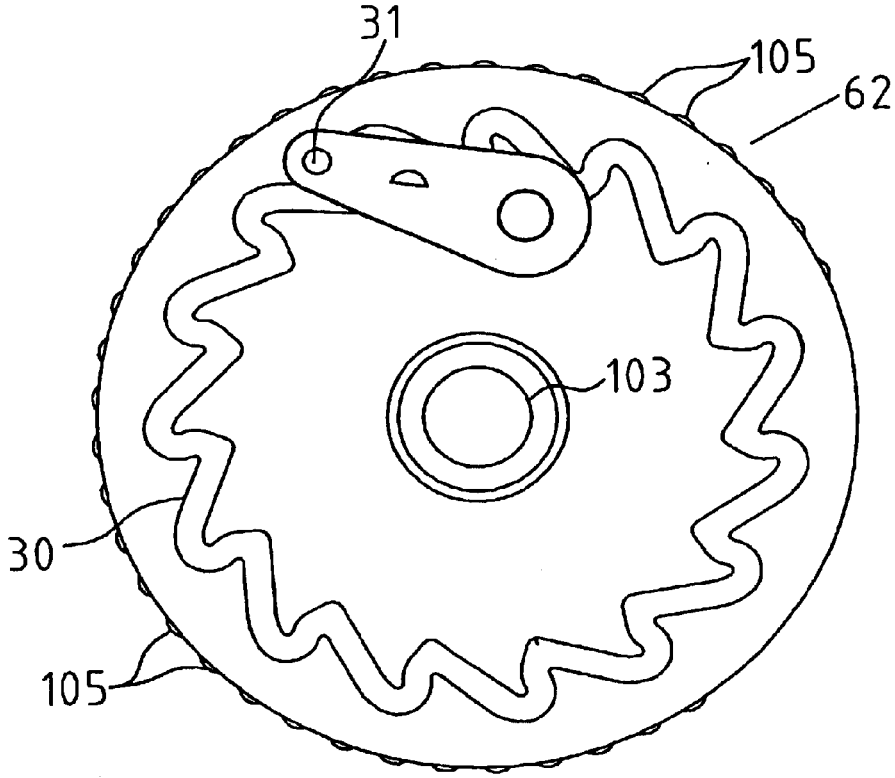

The take-up roller 62 comprises a tubular body 100 mounted between end pieces, namely an inner end piece 101 and an outer end piece 102 each of which as a central through hole 103 for rotatably engaging the bottom spindle 68. Longitudinal ribs 105 extend between opposite ends of the body 100 to prevent excessive gripping of the wet web about the take-up roller 62 thus allowing a used web 4 to be slid axially off the take-up roller 62. A gripper flap 106 is centrally mounted at an exterior of the take-up roller 62 for pivotal movement about a pivot axis substantially parallel to the rotational axis of the take-up roller 62. The gripper flap 106 has an outer free end 107 which overlies an outer surface of the take-up roller 62 for engaging and retaining the web 4 between said outer tree end 107 and the outer surface of the take-up roller 62. Biasing means urges the outer end 107 of the gripper flap 106 against the outer face of the take-up roller 62. The outer end 107 locates within an axial groove 112 which extends between opposite ends of the tubular body 100 and through the outer end piece 102, which receives a leading end 114 of the web 4 (FIG. 18).

The stepped endless track 30 is provided on the inner end piece 101. The pawl 61 and carrier arm 32 is pivotally mounted within a recess 108 in the inner side casing 70. A pawl biasing spring 115 is also mounted in the recess 108. A circlip 109 engages in a complementary circumferential groove at an outer end of the bottom spindle 68 to retain the take-up roller 62 on the bottom spindle 68. A cap 110 closes off the outer end of the take-up roller 62.

In use, the drying apparatus 60 is operated in similar fashion to the previously described drying apparatus. The drying spool 61 with a web 4 of drying material wound about it is mounted on the top spindle 67. A leading edge of the web is then fed between the drying spool 61 an the take-up roller 62 and clamped under the flap 106 on the take-up roller 62 and the take-up roller 62 is rotated once or twice to firmly grip the web 4. As the apparatus 60 is advanced with the take-up roller 62 engaging the floor the web 4 extending about the exterior of the take-up roller 62 dries the floor. As the apparatus 60 is pulled back the pawl 31 releases the take-up roller 62 so that it can advance through an angle sufficiently to bring up dry web 4 onto the take-up roller 62 for the next forward stroke of the apparatus 60. At the start of the forward stroke the pawl 31 will again engage and lock in the track 30 to prevent rotation of the take-up roller 62 on the forward stroke.

The invention is not limited to the embodiments here and before described which may be varied in both construction and detail within the scope of the appended claims.

What is claimed is:

1. A drying apparatus for drying a substantially flat wet surface such as a floor surface, the drying apparatus including:

a support frame, means for rotatably mounting a drying spool on the support frame, said drying spool having a web of liquid absorbent material wound about the spool, a take-up roller rotatably mounted on the support frame, the take-up roller being associated with the drying spool for reception of the web of liquid absorbent material from the drying spool, means for scrolling the web of liquid absorbent material from the drying spool onto the take-up roller in a controlled manner, said scrolling means including indexing means for incrementally feeding the web from the drying spool to the take-up roller in response to engagement and movement of the drying apparatus over the wet surface;

wherein the take-up roller being for engagement with the wet surface for drying said wet surface with the web wound about the take-up roller, the indexing means having means for locking the take-up roller on the support frame during a forward drying stroke of the apparatus in which the take-up roller is rushed across the wet surface and means for temporarily releasing the locking means to allow an incremental turn of the take-up roller to advance the web on the take-up roller before or at the start of each forward drying stroke of the apparatus.

2. A drying apparatus as claimed in claim 1 wherein the indexing means includes a stepped endless track and an associated pawl which is moveable along the track to allow stepped rotation of the take-up roller in one direction and to brake the take-up roller against rotation in the opposite direction, one of the pawl and the track being on the take-up roller and the other of the pawl and the track being on the support frame.

3. A drying apparatus as claimed in claim 2 wherein the endless track comprises a stepped circular groove in an end face of the take-up roller and the pawl is pivotally mounted on the support frame and has a follower pin which travels along said groove.

4. A drying apparatus as claimed in claim 1 wherein a web attachment means is provided on the take-up roller for releasable attachment of a leading edge of the web to the take-up roller, the web attachment means including a gripper flap which is pivotally mounted at an exterior of the take-up roller intermediate the ends of the take-up roller for pivotal movement about a pivot axis substantially parallel to the rotational axis of the take-up roller, said gripper flap having an outer free end which overlies an outer surface of the take-up roller for engaging and retaining the web between said outer free end and the outer surface of the take-up roller, biasing means for the gripper flap which urges the outer free end of the gripper flap towards the outer surface of the take-up roller.

5. A drying apparatus as claimed in claim 1 wherein loading means is provided on the drying spool which co-operates with the spool mounting means to only allow mounting of the spool on the support frame in a desired orientation.

6. A drying apparatus as claimed in claim 1 wherein brake means is provided to resist rotation of the drying spool on the drying spool mounting means.

7. A drying apparatus as claimed in claim 6 wherein said brake means includes complementary interengagable formations on the drying spool and the mounting means for the drying spool, said formations co-operating to resist rotation of the drying spool on the drying spool mounting means.

8. A drying apparatus as claimed in claim 7 wherein said formations comprise interengaging teeth on the drying spool and on the drying spool mounting means.

9. A drying apparatus as claimed in claim 8 wherein the drying spool includes a tubular core about which the web is wound, an end cap mounted at an outer end of said core, a brake arm extending inwardly on said end cap and having a rib forming a tooth on the brake arm, an associated brake element on the support frame has a set of circumferentially spaced-apart teeth for co-operating interengagement with the rib on the brake arm, the rib on the brake arm of the end cap being engagable between adjacent teeth on the brake element, said brake arm being moveable outwardly sufficiently to force the rib over the teeth on the brake element in response to the pulling force applied to the web by the take-up roller when winding the web on the take-up roller.

10. A drying apparatus as claimed in claim 1 wherein a number of spaced-apart radial ribs project outwardly on the surface of the take-up roller, said ribs extending between opposite ends of the take-up roller.

11. A drying apparatus as claimed in claim 1 wherein an outer surface of the take-up roller is TEFLON coated.

12. A drying apparatus as claimed in claim 1 wherein a stand arm is provided on the support frame spaced away from the take-up roller for supporting the drying apparatus on the ground in a free standing position with the stand arm and take-up roller resting on the ground.

13. A drying apparatus as claimed in claim 12 wherein the stand arm is located at a front side of the take-up roller thus ensuring that the roller only engages the ground in a desired orientation associated with indexing of the take-up roller.

14. A drying apparatus for drying a substantially flat wet surface such as a floor surface, the drying apparatus including:

a support frame, means for rotatably mounting a drying spool on the support frame, said drying spool having a web of liquid absorbent material wound about the spool, a take-up roller rotatably mounted on the support frame, the take-up roller being associated with the drying spool for reception of the web of liquid absorbent material from the drying spool, means for scrolling the web of liquid absorbent material from the drying spool onto the take-up roller in a controlled manner, said scrolling means including indexing means for incrementally feeding the web from the drying spool to the take-up roller in response to engagement and movement of the drying apparatus over the wet surface, the take-up roller being for engagement with the wet surface for drying said wet surface with the web wound about the take-up roller, the indexing means having means for locking the take-up roller on the support frame during a forward drying stroke of the apparatus in which the take-up roller is pushed across the wet surface and means for temporarily releasing the locking means to allow an incremental turn of the take-up roller to advance the web on the take-up roller before or at the start of each forward drying stroke of the apparatus, the indexing means having a stepped endless track and an associated pawl which is moveable along the track to allow stepped rotation of the take-up roller in one direction and to brake the take-up roller against rotation in the opposite direction, the endless track comprising a stepped circular groove in an end face of the take-up roller and the pawl being pivotally mounted on the support frame and having a follower pin which travels along said groove.

15. A drying apparatus for drying a substantially flat wet surface such as a floor surface, the drying apparatus including:

a support frame, means for rotatably mounting a drying spool on the support frame, said drying spool having a web of liquid absorbent material wound about the spool, a take-up roller rotatably mounted on the support frame, the take-up roller being associated with the drying spool for reception of the web of liquid absorbent material from the drying spool, means for scrolling the web of liquid absorbent material from the drying spool onto the take-up roller in a controlled manner, said scrolling means including indexing means for incrementally feeding the web from the drying spool to the take-up roller in response to engagement and movement of the drying apparatus over the wet surface, the take-up roller being for engagement with the wet surface for drying said wet surface with the web wound about the take-up roller, the indexing means having means for locking the take-up roller on the support frame during a forward drying stroke of the apparatus in which the take-up roller is pushed across the wet surface and means for temporarily releasing the locking means to allow an incremental turn of the take-up roller to advance the web on the take-up roller before or at the start of each forward drying stroke of the apparatus, the indexing means having a stepped endless track and an associated pawl which is moveable along the track to allow stepped rotation of the take-up roller in one direction and to brake the take-up roller against rotation in the opposite direction, the endless track comprising a stepped circular groove in an end face of the take-up roller and the pawl being pivotally mounted on the support frame and having a follower pin which travels along said groove, brake means associated with the supply spool operable to resist rotation of the drying spool on the drying spool mounting means, said brake means comprising complementary interengagable formations on the drying spool and on the mounting means for the drying spool.

16. A drying apparatus for drying a substantially flat wet surface such as a floor surface, the drying apparatus including:

a support frame, means for rotatably mounting a drying spool on the support frame, said drying spool having a web of liquid absorbent material wound about the spool, a take-up roller rotatably mounted on the support frame, the take-up roller being associated with the drying spool for reception of the web of liquid absorbent material from the drying spool, means for scrolling the web of liquid absorbent material from the drying spool onto the take-up roller in a controlled manner, said scrolling means including indexing means for incrementally feeding the web from the drying spool to the take-up roller in response to engagement and movement of the drying apparatus over the wet surface, the take-up roller being for engagement with the wet surface for drying said wet surface with the web wound about the take-up roller, the indexing means having means for locking the take-up roller on the support frame during a forward drying stroke of the apparatus in which the take-up roller is pushed across the wet surface and means for temporarily releasing the locking means to allow an incremental turn of the take-up roller to advance the web on the take-up roller before or at the start of each forward drying stroke of the apparatus, the indexing means having a stepped endless track and an associated pawl which is moveable along the track to allow stepped rotation of the take-up roller in one direction and to brake the take-up roller against rotation in the opposite direction, the endless track comprising a stepped circular groove in an end face of the take-up roller and the pawl being pivotally mounted on the support frame and having a follower pin which travels along said groove, brake means associated with the supply spool operable to resist rotation of the drying spool on the drying spool mounting means, said brake means comprising complementary interengagable formations on the drying spool and on the mounting means for the drying spool, the take-up roller having a ribbed outer surface, said ribs extending longitudinally between opposite ends of the take-up roller and a web attachment means is provided for attachment of the drying web to an exterior of the take-up roller, said web attachment means comprising a gripper flap which is pivotally mounted at an exterior of the take-up roller intermediate the ends of the take-up roller for pivotal movement about a pivot axis substantially parallel to the rotational axis of the take-up roller, said gripper flap having an outer free end which overlies an outer surface of the take-up roller for engaging and retaining the web between said outer free end and the outer surface of the take-up roller, biasing means for the gripper flap which urges the outer free end of the gripper flap towards the outer surface of the take-up roller.

* * * * *